US006991509B1

(12) United States Patent
Carley et al.

(10) Patent No.: US 6,991,509 B1
(45) Date of Patent: Jan. 31, 2006

(54) ACTIVITY TOY

(75) Inventors: Dean N. Carley, Barrington, RI (US); Gregory R. Horton, Manville, RI (US)

(73) Assignee: Hasbro, Inc., Pawtucket, RI (US)

( * ) Notice: Subject to any disclaimer, the term of this patent is extended or adjusted under 35 U.S.C. 154(b) by 40 days.

(21) Appl. No.: 10/139,630

(22) Filed: May 7, 2002

(51) Int. Cl.
*A63H 30/00* (2006.01)

(52) U.S. Cl. ..... 446/175; 446/397; 434/334; 434/335; 434/393

(58) Field of Classification Search ..... 446/175, 446/227, 484, 303, 297, 397; 434/259, 334, 434/335, 337, 340, 169, 170, 171, 393; 273/430, 273/448, 454, 123 A, 118 A
See application file for complete search history.

(56) References Cited

U.S. PATENT DOCUMENTS 1,678,573 A * 7/1928 Nakashima ..... 273/123 A
2,594,434 A * 4/1952 Hofsetz ..... 200/5 R
2,651,520 A * 9/1953 Ragusin ..... 273/118 D
3,085,803 A * 4/1963 Krzes ..... 273/238
3,300,217 A * 1/1967 Franklin ..... 273/238
4,274,638 A * 6/1981 Jullien ..... 273/238
4,348,191 A * 9/1982 Lipsitz et al. ..... 434/308
4,820,233 A * 4/1989 Weiner ..... 446/303
4,840,375 A 6/1989 Lawlor et al.
4,869,701 A * 9/1989 Kawai et al. ..... 446/91
4,930,776 A * 6/1990 Newcomb et al. ..... 473/570
4,968,255 A * 11/1990 Lee et al. ..... 434/159
5,195,919 A * 3/1993 Hasegawa ..... 446/397
5,240,260 A * 8/1993 Strongin ..... 273/445
5,377,996 A * 1/1995 Shure ..... 273/330
5,389,031 A 2/1995 Sharpe, III et al.
D405,563 S 2/1999 Baiera et al.
5,906,369 A 5/1999 Brennan et al.
6,227,931 B1 5/2001 Shackelford
6,257,948 B1 7/2001 Silva
6,353,168 B1 * 3/2002 Sosoka, Jr. et al. ..... 84/600

* cited by examiner

*Primary Examiner*—Bena Miller
(74) *Attorney, Agent, or Firm*—Fish & Richardson P.C.

(57) ABSTRACT

An activity toy includes a base with an upper surface that has recessed regions. Elements are positionable in each recessed region. Positioning an element in each recessed region produces a sound. For instance, the sound may be a combination of sounds when more than one element is position in the recesses or a verse of a song that is associated with an element. In addition, the base may be a toy vehicle, with the recesses defining positions in the vehicle. The sound may depend on the position of the elements in the vehicle. The recesses may include a forward recess near the front of the vehicle and a secondary recess located behind the forward recess, and the sound produced may depend on whether an element is placed in the forward or secondary recess.

26 Claims, 13 Drawing Sheets

ACTIVITY TOY

TECHNICAL FIELD

This invention relates to interactive toys for toddlers.

BACKGROUND

Interactive toys and games for toddlers that produce melodies or phrases in response to the pressing of a button are well known.

SUMMARY

In one general aspect, an activity toy includes a base with an upper surface that has recessed regions. Elements are sized to fit in the recessed regions. Positioning an element in a recessed region causes the toy to produce a sound.

Implementations may include one or more of the following features. For example, the recessed region may be a hemispherical dimple in the upper surface of the base. The dimple may have a dimple switch that is actuated when an element is positioned in the dimple.

The base may include a sound switch that changes the sound mode when the sound switch is actuated. Positioning several of the elements in the recessed regions may produce a combination of sounds. The sound may be, for example, music, a tone or a phrase.

The elements may be balls. The balls may be made of a translucent material in a variety of colors. The activity toy also may produce light when a moveable element, such as, for example, a ball, is placed in a recessed region.

In another general aspect, playing with an activity toy includes providing an activity toy with the features described above, positioning an element such as a ball above the upper surface of the toy, and dropping the element into a dimple to produce a sound.

In another general aspect, an activity toy includes a body having recessed regions, elements each having differently identifiable features, and a circuit configured to identify an element and to produce a unique sound in response to placement of the element in a recessed region.

Implementations may include one or more of the following features. For example, the body may be a vehicle, such as, for example, a tractor or a rowboat. The elements may be figures having characteristics of a person or animals. Each figure may include an electrical component with unique electrical characteristics, such as, for example, a resistor having a unique resistance value. The circuit may identify the element by measuring a dynamic electrical state of the circuit relating to the electrical characteristic of the electrical component. For example, the dynamic electrical state of the circuit may be a period of time to charge a reactive electrical component, such as, for example, a capacitor, above a threshold voltage.

The details of one or more implementations of the invention are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figure 1:
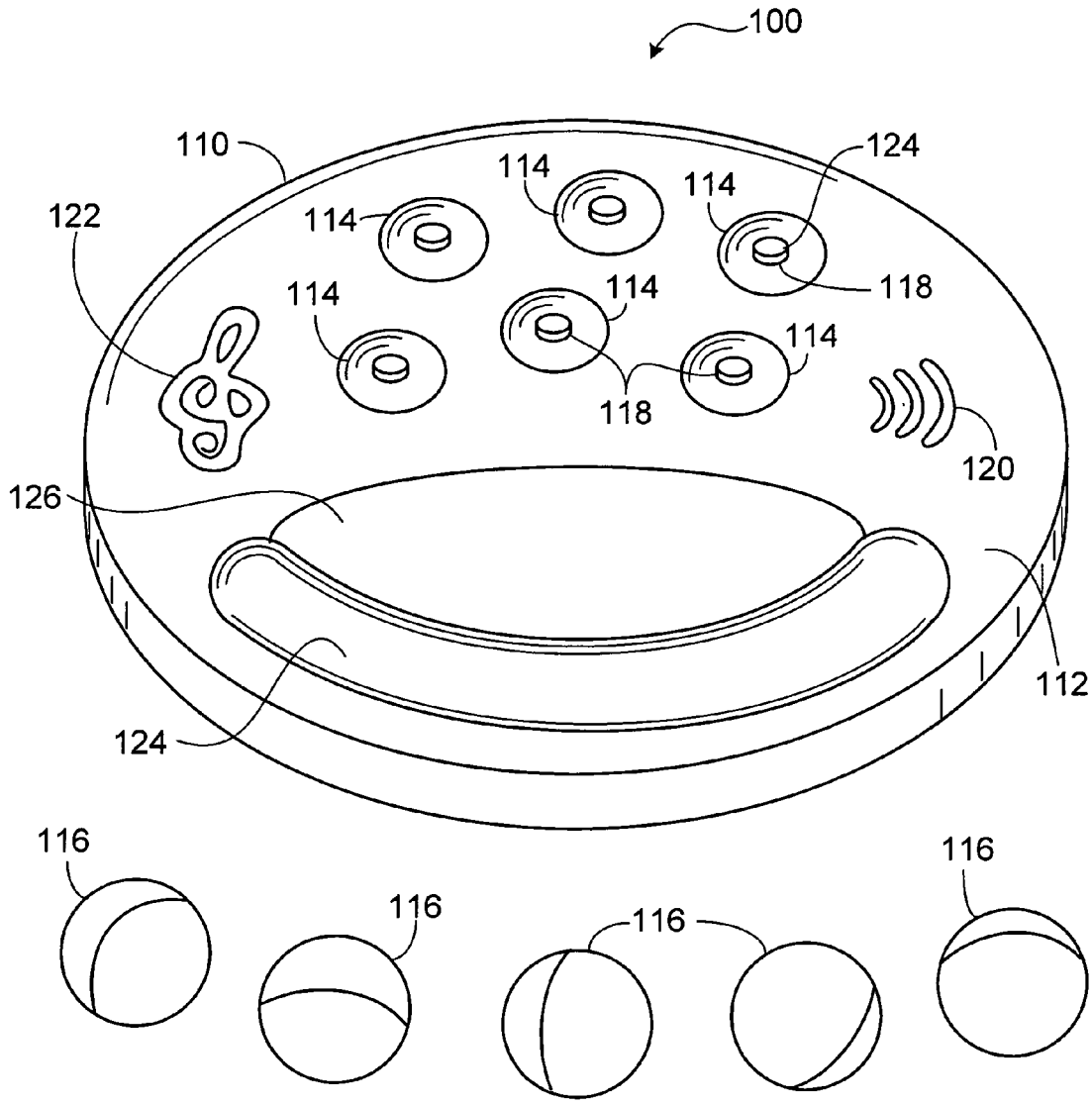
FIG. 1 is a perspective view of an activity toy.

Referring to FIG. 1, an activity toy 100 includes a base 110 having an upper surface 112 with hemispherical dimples 114 and balls 116 that can be positioned in the dimples 114. The dimples 114 include dimple switches 118 that cause the toy to produce sounds when they are actuated. A dimple switch 118 can be actuated by placing a ball 116 in the dimple 114 or by pressing the dimple switch 118 with a finger (not shown). Actuating more than one dimple switch 118 at a time can produce a variety of sounds or a combination of sounds. In one implementation, the balls are made from translucent plastic in a variety of colors including red, yellow, green, orange, blue, and teal.

The upper surface 112 of the base 110 includes a sound port 120 and a sound switch 122. The sound port 120 is a series of cut-outs that allows a speaker in the base (not shown) to transmit sound. The sound switch 122 may be shaped as a musical note, such as, for example, a clef. Pressing the sound switch 122 produces a voice and also changes the sound mode between modes that produce music, phrases, and sounds.

The base also includes a mode switch (not shown). Actuating the mode switch changes modes between demonstration mode, play mode with loud volume, and play mode with soft volume. In play mode, the toy 100 is ready for play. In demonstration mode, the activity toy can simulate the sounds and melodies created by playing with the toy 100.

The upper surface 112 of the base 110 includes a ball tray 124. The ball tray is a recess in the base 110 that holds the balls. A slanted area 126 above the ball tray 124 guides balls into the ball tray 124.

Figure 2:
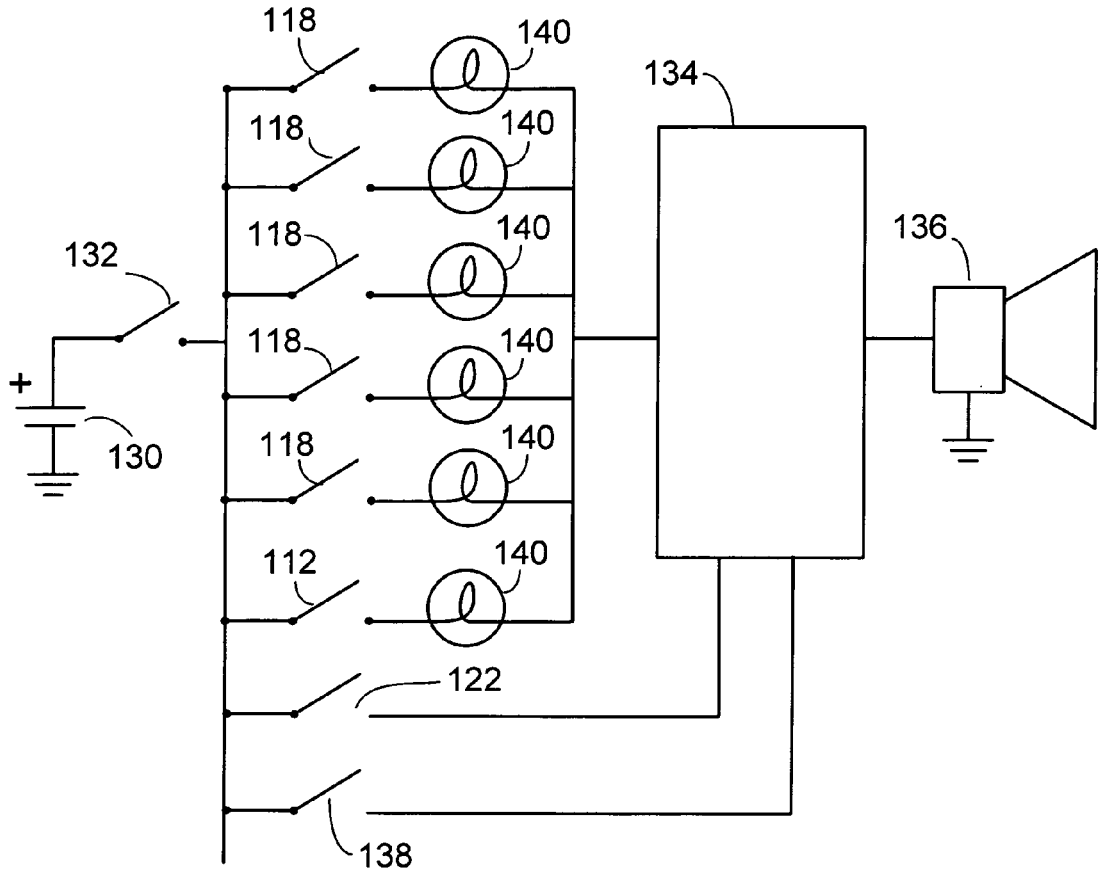
FIG. 2 is a block diagram of a sound processor circuit for the activity toy of FIG. 1.

Referring to FIG. 2, a sound processor circuit 128 located inside the base 110 produces sounds. The circuit 128 includes a battery 130, a power switch 132, dimple switches 118, a sound switch 122, a sound generator 134, a speaker 136, and a mode switch 138. The power switch 132, which is located on the base 110, provides power to the sound processor circuit 128. The dimple switches 118, sound switch 122, and mode switch 138 provide inputs to the sound generator 134.

Lights 140 are mounted inside the base 110 directly under each dimple switch 118. Each light 140 is electrically connected to a dimple switch 118 so that the light 140 is activated when the switch 118 is actuated. The light 140 illuminates a translucent ball 116 positioned in the dimple to make the ball appear to glow.

The sound generator 134 is a microprocessor that is programmed with a variety of sounds. The sounds can be phrases or music that are repeated in a sequence or in a random order. The sound generator 134 produces a combination of sounds when several of the dimple switches are actuated simultaneously.

The sound generator 134 changes sound modes between music, sounds, and phrases when the sound switch 122 is actuated. The output of the sound generator 134 is connected to the speaker 136. The sound generator 134 also may include an amplifier circuit (not shown) to increase the volume of the sound.

Figure 3:
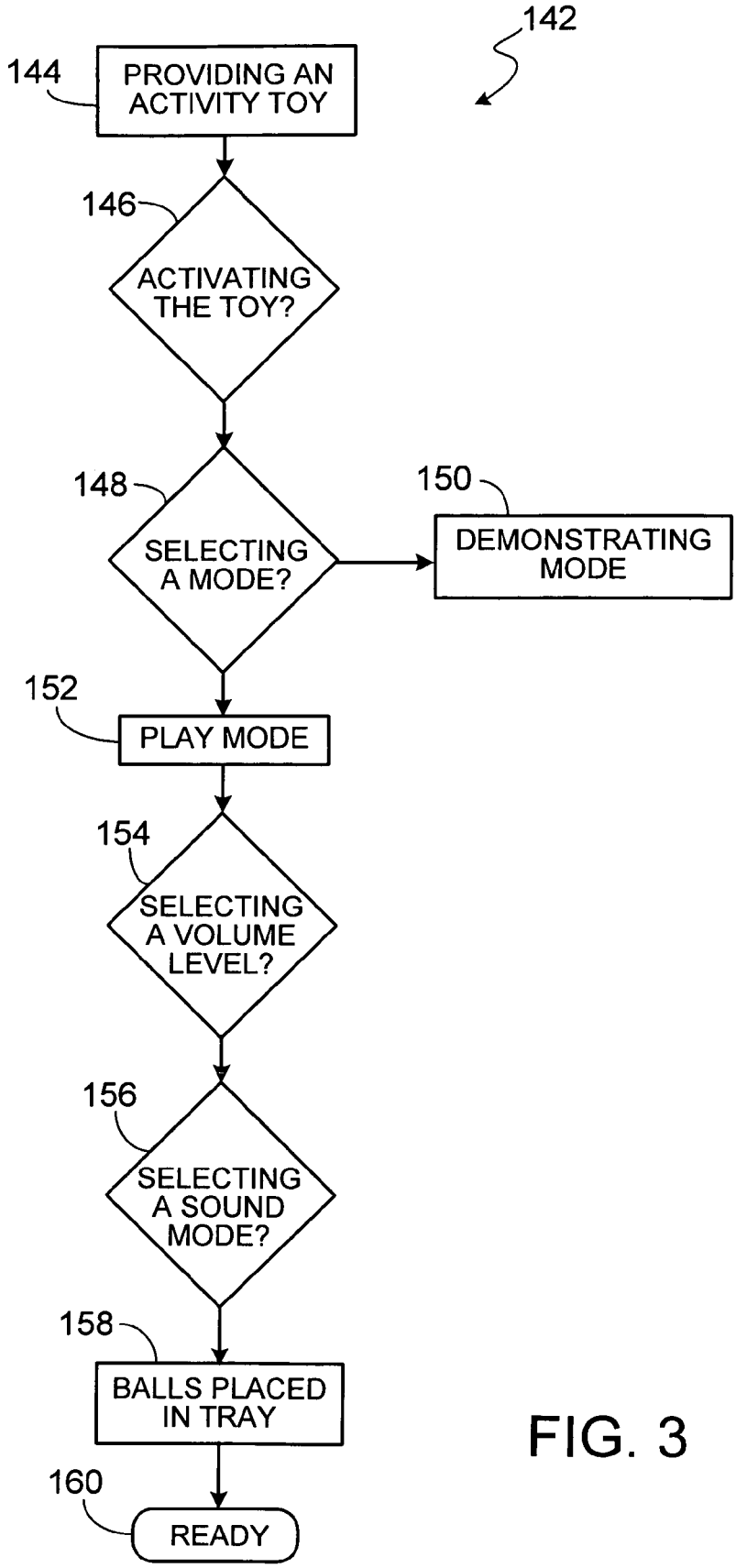
FIGS. 3 and 4 are flow charts of a process for playing with the activity toy of FIG. 1.

Referring to FIG. 3, the game is prepared for play according to a procedure 142. The player is provided with an activity toy that has the features described above (step 144). The player turns the game on by activating the power switch (step 146). The mode switch prepares the toy for play or for demonstration (step 148). If the player is not familiar with the game or would like to observe the game, the player can select the demonstration mode using the mode switch (step 150). In the demonstration mode, the activity toy may produce sounds and light and may provide the user with playing instructions.

To ready the game for play, the player selects a play mode (step 152). The player also may choose between play modes (step 154) with loud or soft volumes. In one implementation, the mode switch 138 may be a three position switch that allows the user to select between a demonstration mode, a play mode with loud volume, and a play mode with soft volume. In another implementation, the activity toy 100 has a separate volume switch that allows the player to select loud or soft volumes.

Next, the player presses the sound switch 122 to select from the desired sound modes of music, voice and sounds (step 156). In one implementation, the sound circuit 100 is programmed to begin in the music mode. Each time that the sound switch 122 is pressed, the sound circuit may advance to the next sound mode until the desired sound mode is selected. In another implementation, pressing the sound switch 122 without any balls 116 in the dimples 114 produces a few measures of music notes when the toy 100 is in music mode. In addition, a metronome sound may then play for about 15 seconds to indicate that the toy 100 is in music mode. In a further implementation, pressing the sound switch 122 while a song is playing changes the song to the next song in a sequence.

In yet another implementation, the toy 100 may have a sound effects mode. In this implementation, a specific sound effect may play each time a specific dimple switch 118 is actuated. Thus, a young player may learn to associate a specific sound to the action of pressing a specific dimple switch 118. A rhythmic xylophone may sound when the sound switch 122 is pressed to indicate that the toy 100 is in sound effects mode. In this implementation, the toy 100 may revert from sound effects mode to music mode after about a minute of inactivity. A few measures of a tune may then be produced to indicate that the toy 100 is back in music mode.

The balls are then placed in the ball tray (step 158) and the game is ready to start (160). The ball tray 124 may also be used for storage of the balls 116.

Figure 4:
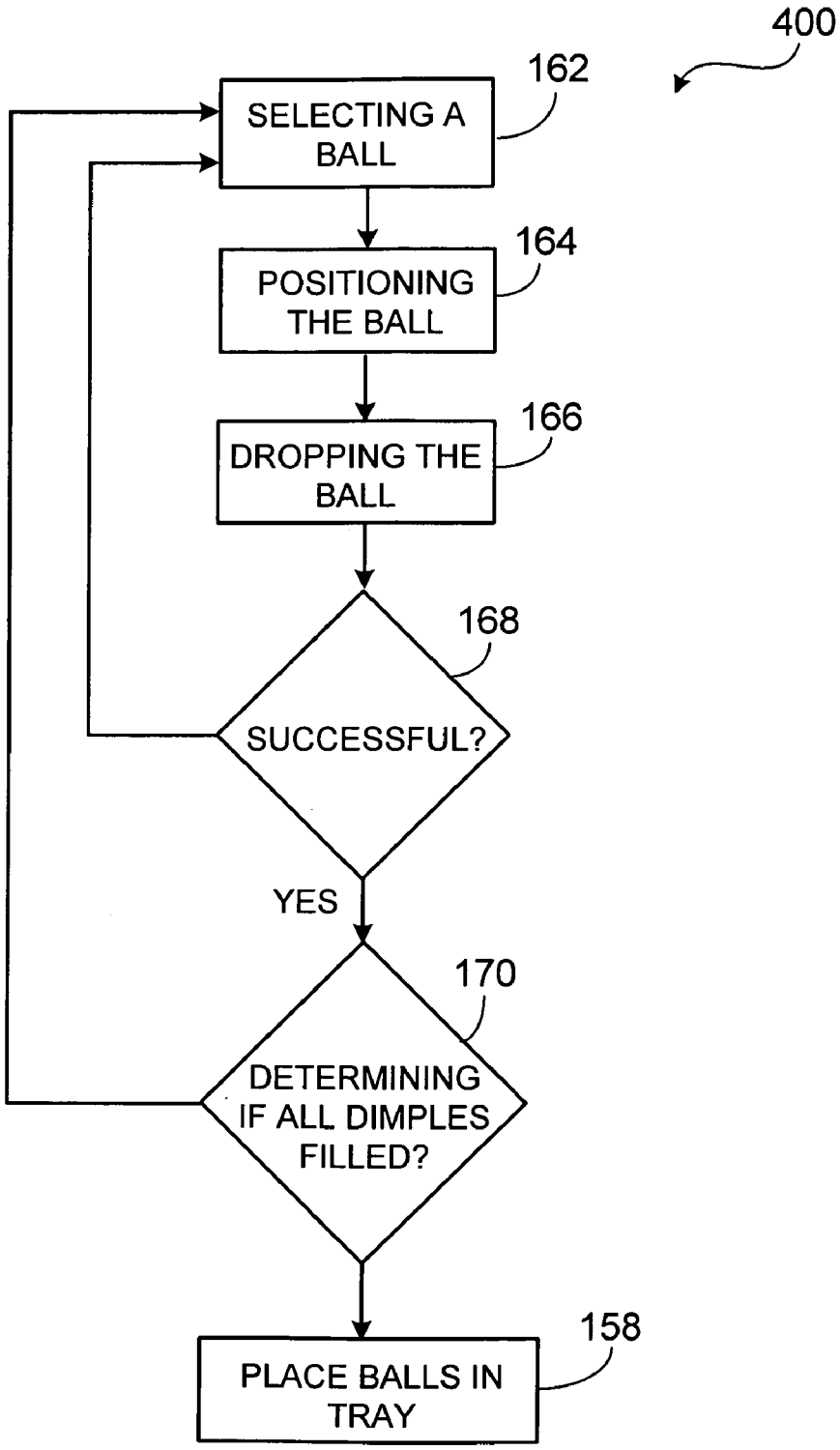

Referring to FIG. 4, the game is played according to a procedure 400. The player selects a ball from the ball tray (step 162). The player positions the ball over a dimple (step 164). Next, the player drops the ball with the goal of placing the ball in the dimple (step 166). If the ball misses the dimple, it may roll off the toy or into the ball tray. If the player is successful in dropping the ball into the dimple, the player selects another ball (step 168). As more balls are dropped into dimples, the activity toy produces a combination of sounds. Once the player position balls in all of the dimples (step 170), the game may be played again by placing the balls back into the ball tray (step 158). If no switch is activated within a period of time, the activity toy 100 goes into sleep mode. Once the toy 100 is reactivated, play resumes at the next song in the sequence.

Figure 5:
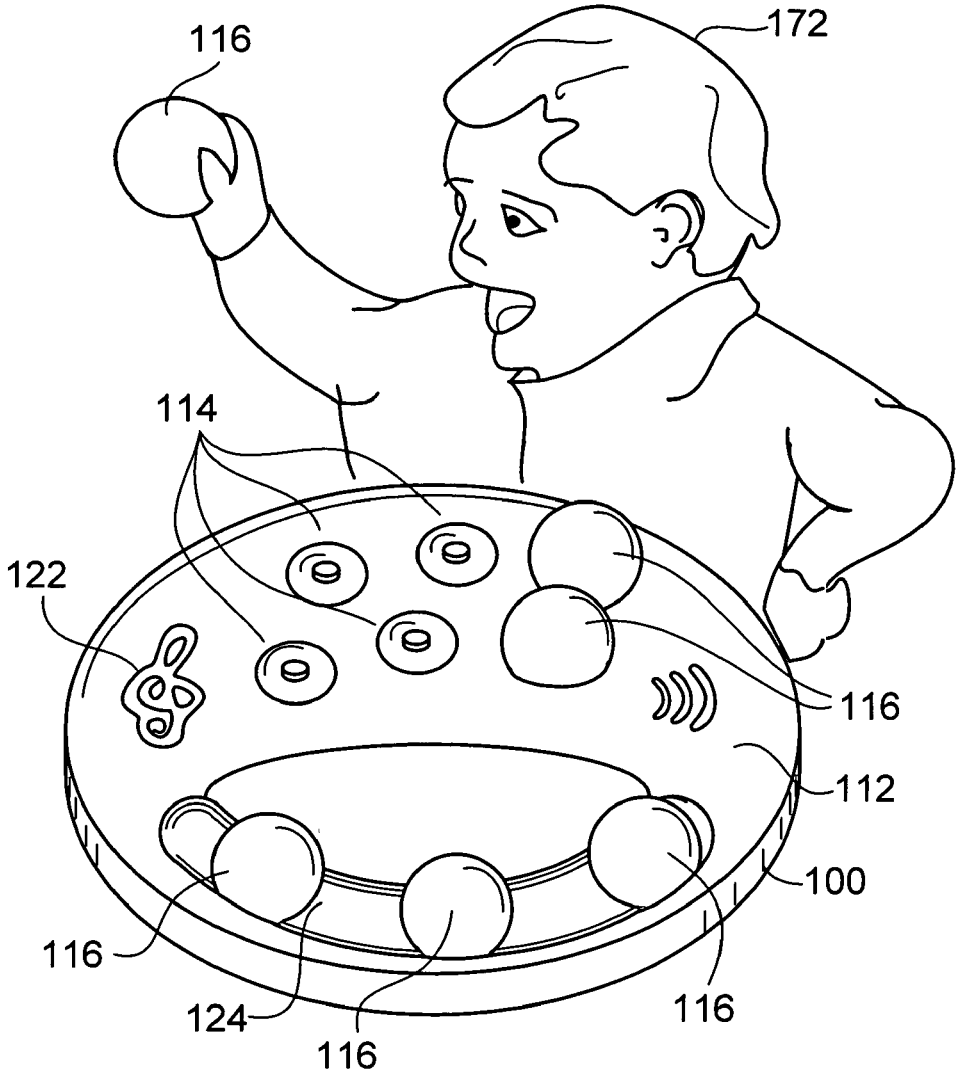
FIG. 5 is a perspective view of a toddler playing with the activity toy of FIG. 1.

Referring to FIG. 5, a player 172 is shown positioning a ball 116 over the upper surface 112. The player 172 must position the ball 116 directly over a dimple before the ball 116 is dropped. Otherwise, the ball 116 falls off of the toy 100 or back into the ball tray 124 and the player 172 starts again. Depending on the age and the physical coordination of the player 172, the balls 116 may be dropped from greater or lesser heights, tossed, or placed directly into the dimples 114.

The activity toy 100 is appropriate for a very young child. The sounds and light provide stimulation and amusement and assist a toddler in discovering music and other sounds. As the child learns more about music, the child can combine sound tracks by positioning balls 116 in several of the dimples 114. Game play also helps to develop coordination and motor skills. The base 110 of the activity toy 100 may have a relatively low height to allow a toddler that is still learning to walk to play from a seated position.

Figure 6:
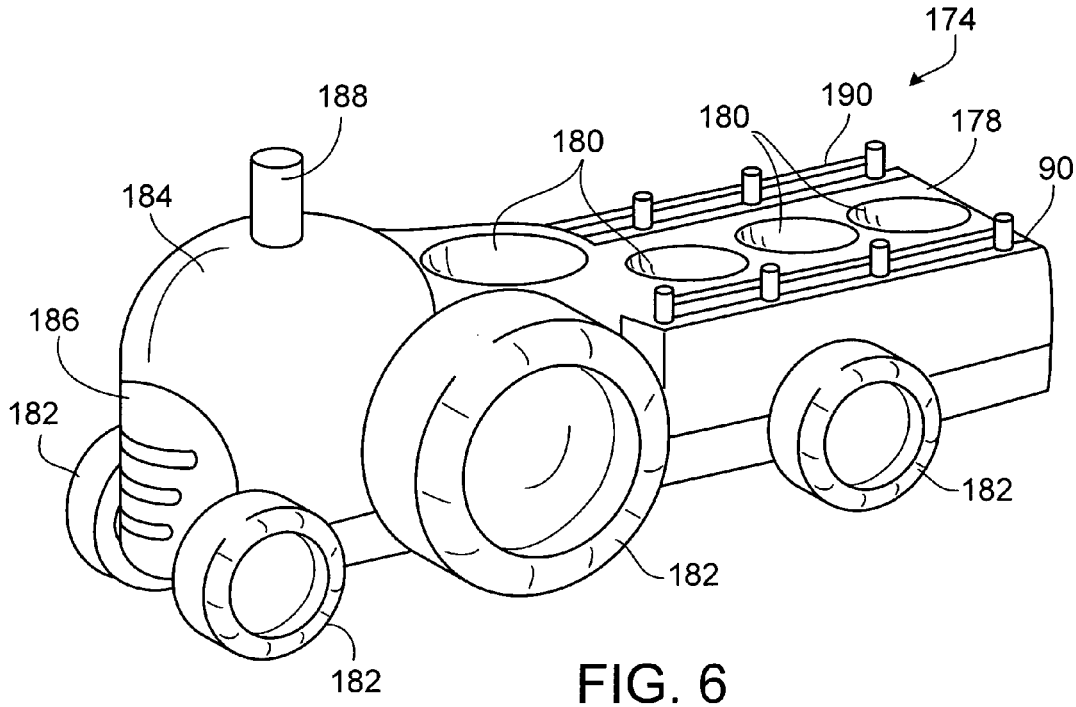
FIG. 6 is a perspective view of an activity toy tractor.
Figure 7A:
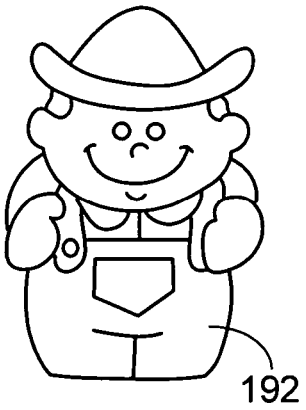
FIGS. 7A–7D are perspective views of farm characters for use with the activity toy tractor of FIG. 6.
Figure 7B:
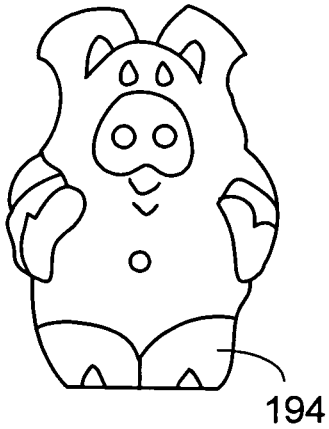
Figure 7C:
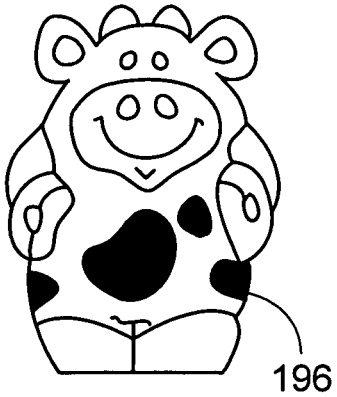
Figure 7D:
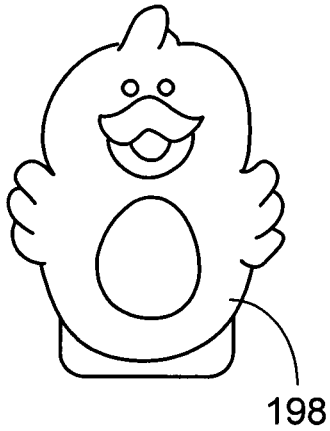
Figure 8A:
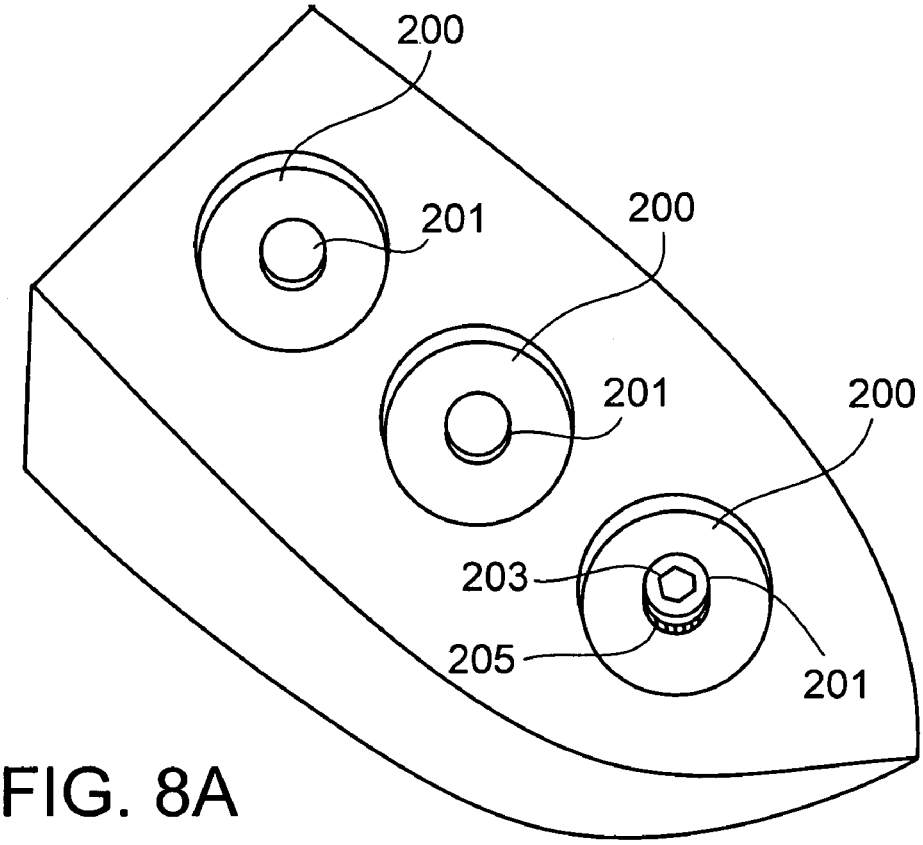
FIG. 8A is a perspective of an activity toy rowboat.

Referring to FIGS. 6 and 8A, an activity toy can be shaped as a vehicle, such as, for example, a farm tractor 174 or a rowboat 176. As shown in FIG. 6, the tractor 174 includes an upper surface 178 with recessed regions 180. The tractor has other features, such as wheels 182, an engine compartment 184, a front grill 186, a smoke stack 188, and side rails 190.

Referring to FIGS. 7A–7D, figures with a farm theme, such as, for example, a farmer 192, a pig 194, a cow 196, and a duck 198, are configured to be positioned in the recessed regions 180 of the tractor 174.

Figure 8B:
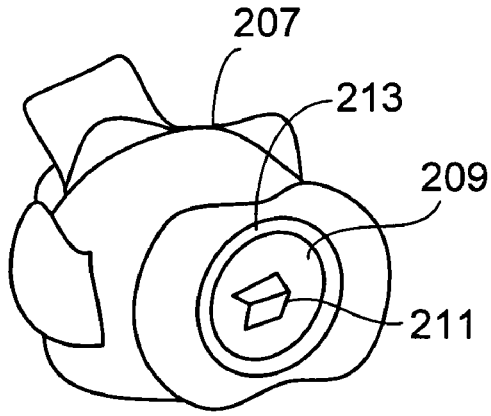
FIG. 8B is a perspective bottom view of a sea-going character for use with the activity toy rowboat of FIG. 8A.

Referring to FIG. 8A, the rowboat 176 includes recessed regions 200, with each recessed region having a raised post 201 having a center contact 203 and an outer contact 205. Referring also to FIG. 8B, a FIG. 207 may be positioned in the recessed region 200. The bottom of the figure has a hole 209 with a center conductor 211 and an outer conductor 213. With the FIG. 207 positioned in the recessed region 200, the center contact 203 makes contact with the center conductor 211 and the outer contact 205 makes contact with the outer conductor 213.

Figure 10:
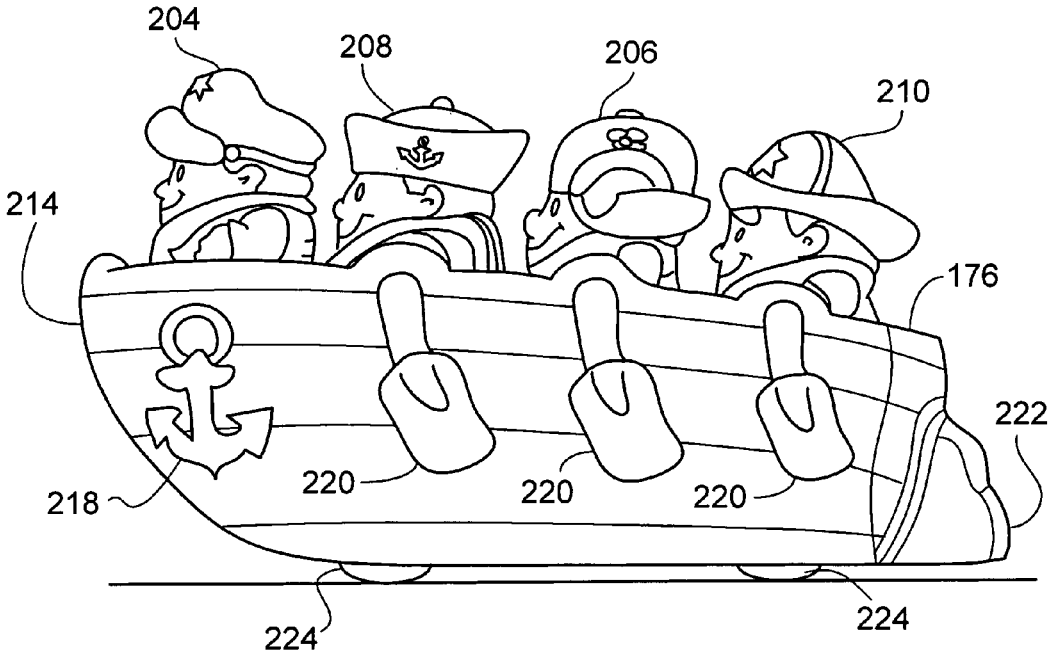
FIG. 10 is a side view of the activity toy rowboat of FIG. 8A with the sea-going characters of FIGS. 9A–9D positioned therein.

Referring to FIGS. 9A–9D, figures with a sea-going theme, such as, for example, crew members including a captain 206, sailors 208, 210, and a mate 212, are configured to be positioned in the recessed regions 200 of the rowboat 176. Referring to FIG. 10, each of FIGS. 206, 208, 210, and 212 may be inserted into any of the recessed regions and may, but need not, face the bow 214 of the rowboat 176.

Figure 8C:
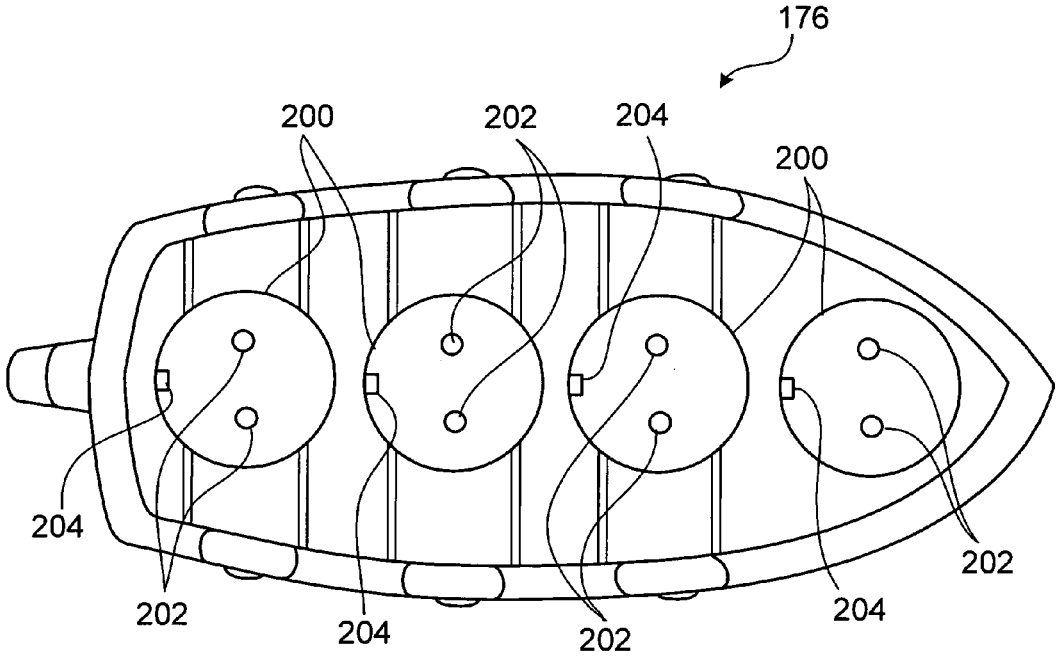
FIG. 8C is a top view of the activity toy rowboat of FIG. 8A.

Referring to FIG. 8C, in another implementation, the recessed region 200 has contact posts 202 and a ridge 204. In the alternative implementation described with respect to FIG. 8C, each of FIGS. 206, 208, 210, 212 has a slot (not shown) that matches the ridge 204 such that the figures must face the bow 214 of the rowboat 176 in order to be properly positioned in the recessed regions 200.

Figure 9A:
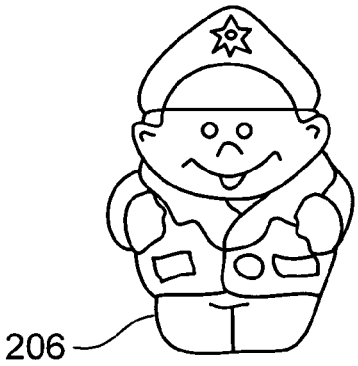
FIGS. 9A–9D are perspective views and FIG. 9E is a cut-away view of sea-going characters for use with the activity toy rowboat of FIG. 8A.
Figure 9B:
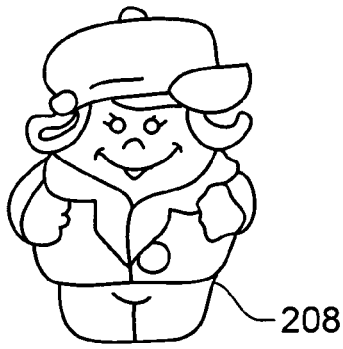
Figure 9C:
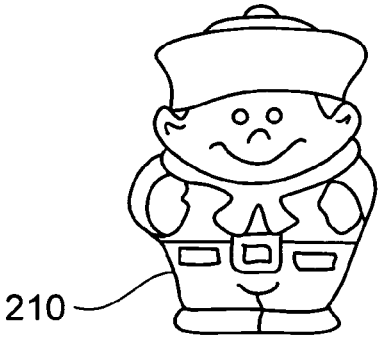
Figure 9D:
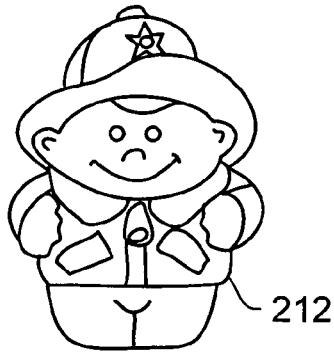
Figure 9E:
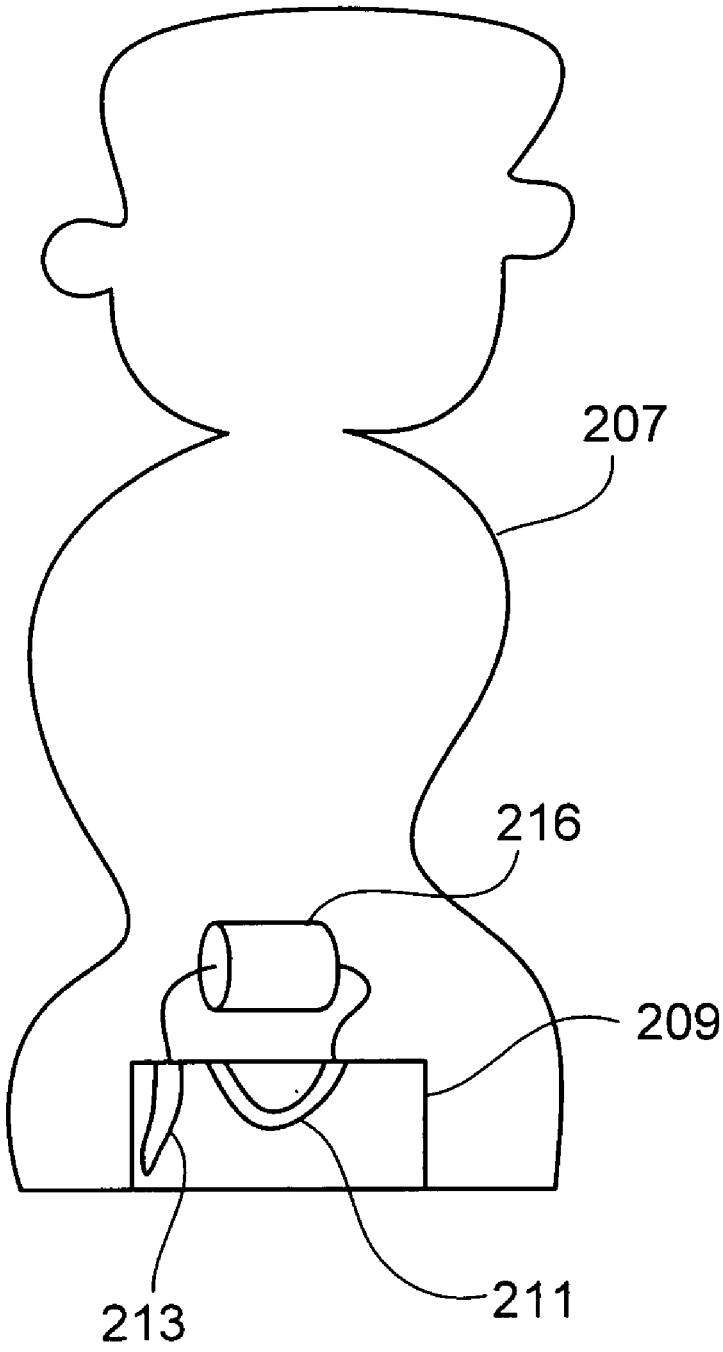

Referring to FIG. 9E, each figure includes a resistor 216 that is connected between the center conductor 211 and the outer conductor 213. The resistor 216 in each figure may have a different resistance value. When a figure is positioned as shown in FIG. 10, an electrical circuit through the resistor 216 is completed by contact between the center contact 203 with the center conductor 211 and the outer contact 205 with the outer conductor 213.

The rowboat 176 has other sea-going features, such as, for example an anchor 218, oars 220, and a rudder 222. The rowboat also has wheels 224 for motion on flat surfaces.

Figure 11:
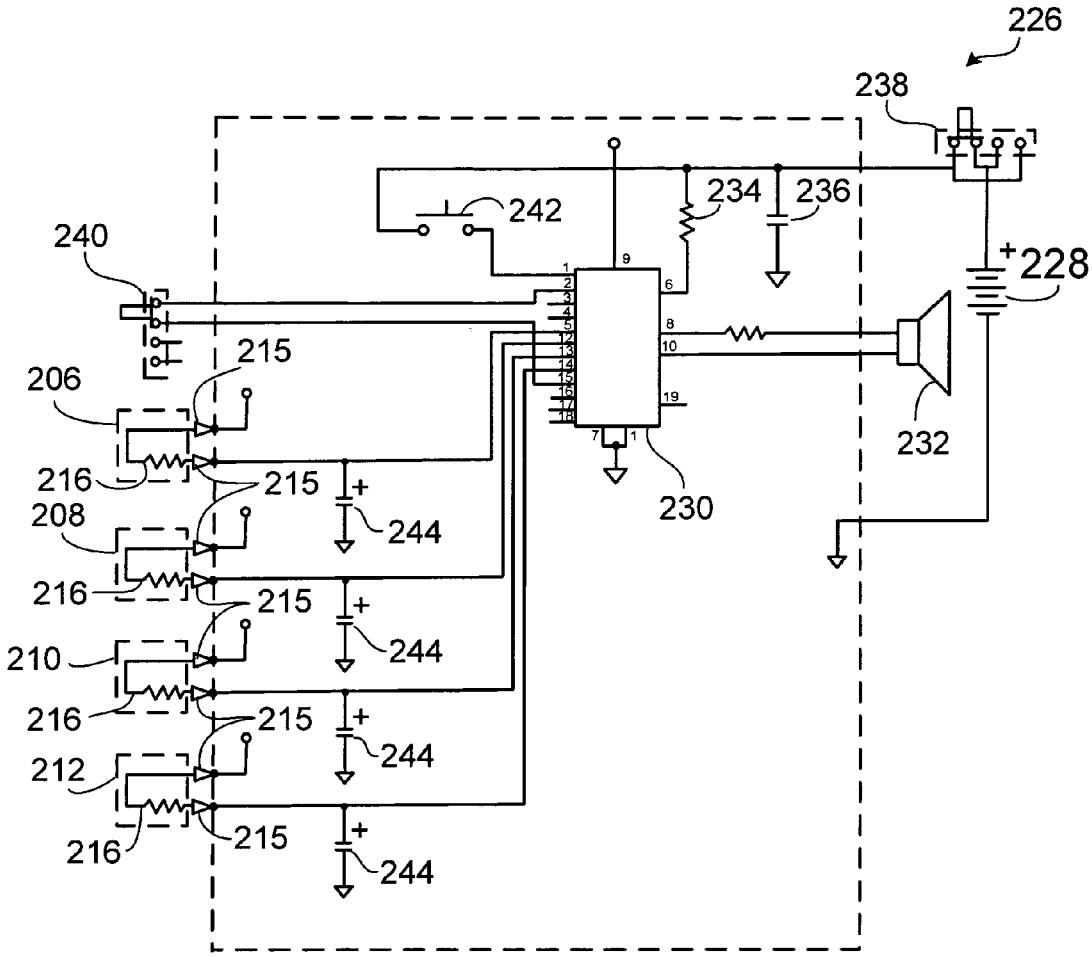
FIG. 11 is a circuit diagram of a sound circuit for the activity toy tractor of FIG. 6 and the activity toy rowboat of FIG. 8A.

Referring to FIG. 11, the tractor 174 and the rowboat 176 each have a sound circuit 226 that can be actuated by positioning the toy's respective figures in the recessed regions 180, 200. The sound circuit 226 includes a power supply 228, an integrated circuit 230, and a speaker 232. In one implementation, the integrated circuit 230 is a Sonix SNC582 dual-channel directive drive speech controller. Other implementations may use other integrated circuits with similar features.

A resistor 234 is connected between the power supply 228 and the integrated circuit 230 to establish an oscillation frequency. A capacitor 236 is also connected to the power supply 236 to reduce voltage fluctuations. A power switch 238 and a mode switch 240 are ganged together to provide power to the circuit 226 and to program the circuit for either demonstration or play mode.

A switch 242 is incorporated into the tractor 174 or the rowboat 176 to allow a user to actuate the sound circuit without insertion of a figure in the recessed regions. For example, the switch 242 may be positioned in the smokestack 188 of the tractor 174 or behind the anchor 218 of the rowboat 176. When the smokestack 188 or the anchor 218 is pressed, the switch 242 actuates the sound circuit 226.

Each pair of contact posts 202 includes one post connected to a terminal of the integrated circuit 230 and one post connected a supply voltage such that a circuit including a resistor 216 is established between the supply voltage and the terminal of the integrated circuit when a figure is positioned in a recessed region. Capacitors 299 are connected between these terminals of the integrated circuit and electrical ground.

Depending on the resistance of the resistor 216, the capacitor 244 charges from ground potential to a threshold voltage in a set period of time. The integrated circuit 226 measures and stores the capacitor charging time period. Thus, figures can be differentiated by the sound circuit 226 based on unique resistance values of the resistors 216 located in each figure. Typical values for the timing components of the sound circuit 226 are between 15K–100K ohms for the resistor 216 and 1 microfarad for the capacitor 244.

In operation, the toy 174 or 176 plays different sounds and music depending on the position of the figures. For example, when the farmer is placed in the forward recessed region of the tractor (driver position), the toy determines if the other farm animals are present. If no other farm animal is in the tractor, the farmer stops to ask: "Hey, where is everyone?" If farm animals are positioned in the tractor, the farmer states, "here we go," and the song "Old MacDonald" along with accompanying instrumental music begins to play.

Different verses of the song will play depending on which farm animal is present. For example, the song may begin: "Old MacDonald (that's me!) giggle has a tractor, ee i ee i oh!" If the pig is in the tractor, the farmer voice sings, "And on my tractor I have a pig, ee i ee i oh! With an oink-oink here, and an oink—oink there, here oink—oink there oink—oink, everywhere oink—oink." If the cow is in the tractor, the song continues, "and on my tractor I have a cow, ee i ee i oh! With a moo—moo here, and a moo—moo there, here a moo—moo, there a moo—moo, everywhere a moo—moo." And if the duck is present, the song continues, "And on my tractor I have a duck, ee i ee i oh! With a quack—quack here, and a quack—quack there, here a quack—quack, there a quack—quack, everywhere quack—quack."

If any character is removed during the song, the toy utters "uh-oh", then continues the song. If the pig, cow or duck are placed in the driver position, the animal states: "Uh-oh . . . I can't drive . . . " and sound effects made by that animal begin playing, such as, for example, oink, moo or quack sounds. If all characters are removed, the toy plays an instrumental version of "Old MacDonald."

The rowboat sounds are based on a sea-going theme and the song "Row Your Boat." Various scripts also are played depending on the character positioned in the rowboat. If the captain is in the captain's position closest to the bow, the captain states "Hey?! Where is everyone?" if other characters are not present, or "Here we go . . . " if other characters are present. If a sailor is placed in the rowboat without the captain, the sailor exclaims, "Uh-oh?! I can't sail by myself! (giggle)" The toy then begins playing: "Row, row, row your boat, gently down the stream, merrily, merrily, merrily . . . life is but a dream." Various instrumentals also play along with the song depending on the characters positioned in the rowboat.

A number of implementations have been described. Nevertheless, it will be understood that various modifications may be made. For example, a ball tray may be configured to extend around the entire perimeter of the base to keep dropped balls on the base. In another implementation, a switch may be located in the ball tray to produce a sound when a dropped ball actuates the switch. In a further implementation, the toy may be another type of vehicle, such as, for example, a train or an airplane. Accordingly, other implementations are within the scope of the following claims.

What is claimed is:

1. An activity toy comprising:

a base having a generally horizontal upper surface with hemispherical dimples and a ball tray;

translucent balls positionable in the dimples; and a sound circuit that comprises:

dimple switches positioned in the dimples and configured to produce a sound one of the balls when is positioned in a dimple and to produce the combination of sounds when more than one ball is positioned in the dimples;

a sound switch mounted on the base and connected to cause the sound circuit to change a sound mode when the sound switch is actuated;

a mode switch on the base and connected to cause the sound circuit to change a status mode between a play mode and a demonstration mode; and lights that are illuminated in response to placement of the balls in the dimples.

2. The activity toy of claim 1 wherein the dimple switches are configured to produce a sequence of sounds as the balls are positioned in the dimples.

3. The activity toy of claim 2 wherein the sound mode includes music.

4. The activity toy of claim 1 wherein the sound mode includes tones.

5. The activity toy of claim 1 wherein the sound mode includes phrases.

6. An activity toy comprising:

a base having at least a first recess and a second recess;

a translucent ball configured to be placed into the first recess;

an element configured to be placed into the second recess; and a sound circuit configured to:

play a first sound when the ball is in the first recess;

when the element is placed into the second recess while the ball is in the first recess, play a second sound while the first sound is being played so as to produce a combination of sounds; and the sound circuit includes a light that is illuminated in response to placement of the ball in the first recess.

7. The activity toy of claim 6 wherein the first recess and the second recess are each in the shape of a hemispherical dimple.

8. The activity toy of claim 7 wherein the sound circuit includes a first dimple switch positioned in the first recess to be actuated by placement of the ball in the first recess.

9. The activity toy of claim 6 wherein the sound circuit includes a sound switch mounted to the base and connected to cause the sound circuit to change a sound mode when the sound switch is actuated.

10. The activity toy of claim 6 wherein the first and second sounds comprise music.

11. An activity toy comprising:

a toy tractor having at least a first recess and a second recess;

a first element having characteristics of a farm animal and configured to be placed in the first or second recess;

a second element having characteristics of a farmer and configured to be placed in the first or second recess; and a sound circuit configured to:

selectively produce one or more consecutive verses of a song, wherein one of the verses is associated with the farm animal and the verse associated with the farm animal is produced when the first element is in the second recess and is not produced when the first element is not in the second recess;

produce a phrase associated with the farm animal when the first element is in the first recess; and produce a sound other than the verse associated with the farm animal when the second element is in the first recess and the first element is not in the second recess.

12. The activity toy of claim 11 wherein:

the first element includes an electrical component having a unique electrical characteristic; and the sound circuit identifies the first element by measuring a dynamic electrical state of the sound circuit, the dynamic electrical state relating to the unique electrical characteristic of the electrical component.

13. The activity toy of claim 12 wherein the dynamic electrical state of the circuit includes a period of time to charge a reactive electrical component above a threshold voltage.

14. The activity toy of claim 13 wherein the reactive electrical component includes a capacitor.

15. The activity toy of claim 14 wherein the electrical component includes a resistor having an electrical resistance.

16. An activity toy comprising:

a toy boat having at least a first recess and a second recess;

a first element having characteristics of a sailor and configured to be placed in the first or second recess;

a second element having characteristics of a boat captain and configured to be placed in the first or second recess; and a sound circuit configured to:

selectively produce one or more consecutive verses of a song, wherein one of the verses is associated with the sailor and the verse associated with the sailor is produced when the first element is in the second recess and is not produced when the first element is not in the second recess;

produce a phrase associated with the sailor when the first element is in the first recess; and produce a sound other than the verse associated with the sailor when the second element is in the first recess and the first element is not in the second recess.

17. The activity toy of claim 16 wherein:

the first element includes an electrical component having a unique electrical characteristic; and the sound circuit identifies the first element by measuring a dynamic electrical state of the sound circuit, the dynamic electrical state relating to the unique electrical characteristic of the electrical component.

18. The activity toy of claim 17 wherein the dynamic electrical state of the circuit includes a period of time to charge a reactive electrical component above a threshold voltage.

19. The activity toy of claim 18 wherein the reactive electrical component includes a capacitor.

20. The activity toy of claim 19 wherein the electrical component includes a resistor having an electrical resistance.

21. An activity toy comprising:

a toy farm tractor having a tractor portion and a trailer portion, the farm tractor including a forward recess near the front of the tractor and at least one secondary recess behind the forward recess, the forward recess being located in the tractor portion of the farm tractor and the at least one secondary recess being located in the trailer portion of the farm tractor;

a first element associated with the secondary recess and configured to be placed into the forward or secondary recess;

a second element associated with the forward recess and configured to be placed into the forward or secondary recess; and a sound circuit configured to:

produce a first sound when the first element is in the forward recess and a second sound when the first element is in the secondary recess;

produce a third sound when the second element is in the forward recess and the first element is not in the secondary recess; and produce a fourth sound when the second element is in the forward recess and the first element is in the secondary recess.

22. The activity toy of claim 21 wherein the first element is shaped like a farm animal and the second element is shaped like a farmer.

23. The activity toy of claim 21 wherein:

the first element has characteristics of a person or an animal; and the sound circuit is configured to selectively produce one or more consecutive verses of a song, wherein one of the verses is associated with the person or animal and the verse associated with the person or animal is produced when the first element is in the secondary recess and is not produced when the first element is not in the secondary recess.

24. An activity toy comprising:

a toy boat, the toy boat including a forward recess near the front of the boat and at least one secondary recess behind the forward recess, the forwarded recess being located at a bow of the boat and the at least one secondary recess being located behind the bow of the boat;

a first element associated with the secondary recess and configured to be placed into the forward or secondary recess;

a second element associated with the forward recess and configured to be placed into the forward or secondary recess; and a sound circuit configured to:

produce a first sound when the first element is in the forward recess and a second sound when the first element is in the secondary recess;

produce a third sound when the second element is in the forward recess and the first element is not in the secondary recess; and produce a fourth sound when the second element is in the forward recess and the first element is in the secondary recess.

25. The activity toy of claim 24 wherein the first element is shaped like a sailor and the second element is shaped like a boat captain.

26. The activity toy of claim 24 wherein:

the first element has characteristics of a person or an animal; and the sound circuit is configured to selectively produce one or more consecutive verses of a song, wherein one of the verses is associated with the person or animal and the verse associated with the person or animal is produced when the first element is in the secondary recess and is not produced when the first element is not in the secondary recess.

* * * * *